United States Patent [19]

Fritsch et al.

[11] Patent Number: 4,463,075

[45] Date of Patent: Jul. 31, 1984

[54] PROCESS FOR FORMING CONDUCTIVE BRIDGE IN CATHODE RAY TUBES

[75] Inventors: Kenneth L. Fritsch, Wheaton; William A. Jordan, Hanover Park, both of Ill.; Hugo A. Lopez, San Diego, Calif.

[73] Assignee: Zenith Electronics Corporation, Glenview, Ill.

[21] Appl. No.: 397,375

[22] Filed: Jul. 12, 1982

[51] Int. Cl.[3] ..... H01J 29/00

[52] U.S. Cl. ..... 430/23; 427/68

[58] Field of Search ..... 430/23; 427/68

[56] References Cited

U.S. PATENT DOCUMENTS 4,212,902 7/1980 Lopez ..... 427/68 X 4,289,800 9/1981 Shah ..... 427/68

*Primary Examiner*—James R. Hoffman

*Attorney, Agent, or Firm*—Ralph E. Clarke, Jr.

[57] ABSTRACT

An improved process for providing positive electrical connection between the shadow mask, the conductive coating and the aluminum film by way of the mask-supporting studs is disclosed. The process is for use in the manufacture of a cathode ray tube having a face panel including a rearwardly extending skirt with a seal land for attachment to a funnel having a mating seal land. The face panel and skirt receive an internal coat of electrically conductive dag. The face panel has an inner surface for receiving a pattern of discrete phosphor deposits overlaid with an electrically conductive aluminum film. The tube includes a shadow mask for color selection receiving a high voltage, and held dependent adjacent to the face panel by a plurality of metal studs extending inwardly from the skirt. The improved process comprises directing a controlled flow of air following the application of the dag coating toward the center of the inner surface of the panel effective to cause a counterflow of air across the skirt to thoroughly dry the dag coating on the skirt. The area of the skirt between the plane of the studs and the skirt seal line is precision-trimmed with acid. The method is such that a permanent electrical connection is maintained between the dag coating and the shadow mask without the need for a separate application of an electrically conductive bridge.

1 Claim, 4 Drawing Figures

PROCESS FOR FORMING CONDUCTIVE BRIDGE IN CATHODE RAY TUBES

BACKGROUND OF THE INVENTION AND PRIOR ART STATEMENT

This invention relates in general to color television picture tubes, and in particular to an improved process for providing an electrical path between certain components within the picture tube envelope.

A color television cathode ray picture tube commonly comprises a glass bulb including a face panel sealed to the flared end of a funnel. A tubular neck extends from the funnel for receiving an electron gun which provides one or more electron beams. The tube face panel has a concave inner surface upon which is deposited groups of phosphors which are excited to luminescence by an electron beam or beams from the gun. A color selection electrode commonly called a "shadow mask" is attached in precise relationship to the face panel by means of a plurality of suspension members which detachably engage metal studs extending inwardly from a rearwardly extending skirt of the face panel. On the internal surface of the funnel is deposited an electrically conductive coating, usually a composition of a dispersed colloidal graphite termed "dag". A high voltage is applied to this coating from an external power source through an anode button in the funnel wall. This high voltage is commonly termed the ultor anode potential.

An electron-pervious film of aluminum is commonly applied over the electron-excitable phosphor screen; this process is termed "aluminizing". The thickness of the aluminum film is typically about 2,000 angstroms. For maximum brightness of the display, and for brightness uniformity, it is necessary that the aluminum film be as smooth and mirror like as possible, and devoid of blemishes such as holes or blisters. Also, the film must firmly adhere to the phosphor layer and must be uniform in thickness so that the electrons projected by the electron gun can penetrate the coating uniformly. A problem arises in achieving these qualities primarily because of the unsmooth characteristic of the phosphor deposits. The problem is largely resolved by depositing a film of an organic material such as a lacquer on the phosphor deposits before application of the aluminum. The film acts to fill in the rough areas, and provides an uneven surface upon which the aluminum film can be deposited and take on the relatively smooth characteristic of the lacquer.

It is essential for proper cathode ray tube operation that the high voltage on the conductive coating of the funnel be also present on both the aluminum film and on the shadow mask. The electrical path for establishing these components at a common ulter anode potentially commonly comprises a spring extending from the shadow mask which is in contact with a high-voltage-charged funnel coating. The potential on the shadow mask is then conducted to the aluminum film through shadow mask suspension springs which are releasably attached to the metal studs which extend from the face panel flange. The studs, which are embedded in the glass of the flange, are intended to be in electrical contact with the aluminum film; however, this contact often fails to be made.

To insure that the studs are in positive electrical contact with the aluminum film, it has been common practice to paint an electrically conductive bridge "mustache" between the studs and the aluminum coating. The conductive material may comprise a water-soluble silicate in a form suitable for manual application by a brush. The water is driven off in a subsequent tube-baking process, leaving a hard, electrically conductive film between the studs and the aluminum film. Problems are inherent in the use of such films. If, for example, the film does not adhere to the components, fragments of the coating can flake off the studs and the glass area and become migrant particles. Such migrant particles can occlude one or more apertures in the nearby shadow mask; it is to be noted that the occlusion of even one such aperture is highly visible to the viewer. Also, the particles can migrate to the gun area and be the cause of inter-electrode arcing or cathode poisoning. Another problem arises from the manual application of the conductive film, which is commonly painted on by means of a brush. Depending upon the skill of the applicator, the quality can vary from perfect to highly questionable. The problem is aggravated by the fact that manual application is tedious especially under the conditions of a third manufacturing shift.

If the conductive film is of the type that is water-soluble, an extra baking cycle may be necessary to make the film adherent. After aluminizing and before applying the conductive film, it has been necessary to bake the tube in a separate step at a temperature of about 400 degrees Centigrade to eliminate the organic film by oxidizing it. This requirement for a separate bake merely to promote adherence of the conductive film is a costly and energy-wasting step as the film can as well be removed by a subsequent frit cycle bake. Alternatively, in lieu of a separate bake to remove the organic film, the film can be removed by solvents. However, the solvent process is an added expense, and the use of solvents, which are usually inflammable, introduces new problems in the cycle of manufacture.

OBJECTS OF THE INVENTION

It is a general object of this invention to increase the performance reliability of color cathode ray picture tubes.

It is a less general object of this invention to reduce the cost of cathode ray tube production, and the amount of energy required in the production process.

It is a more specific object of the invention to reduce production costs and energy consumption by making it possible to eliminate an entire tube bake cycle or a separate solvent-based process.

It is a specific object of the invention to provide a process leading to the elimination of the need to apply an electrically conductive bridge or "mustache" by manual means.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
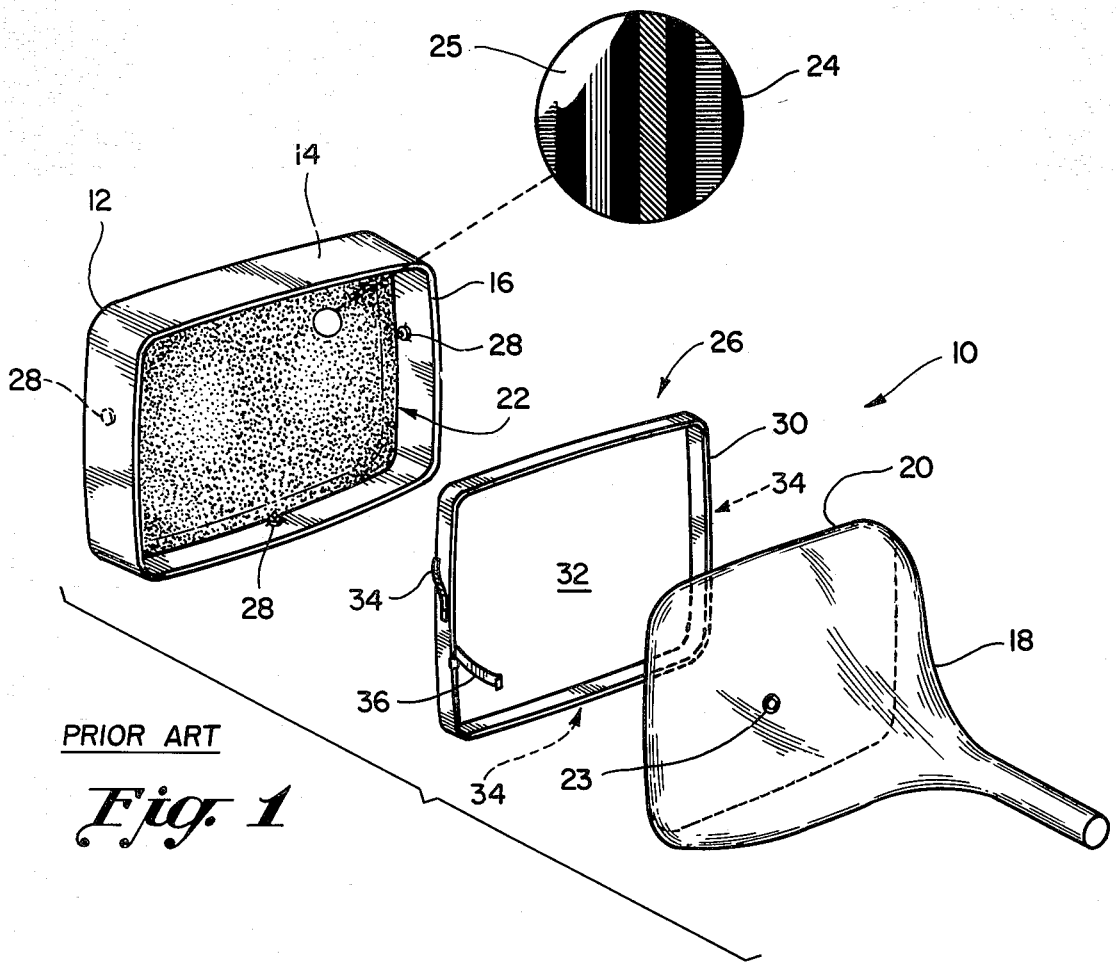
PRIOR ART Fig. 1
FIG. 1 is a view in perspective of a color cathode ray tube with the component parts of the tube exploded therefrom.

The inventive process is for use in the manufacture of a cathode ray picture tube such as used in a television receiver. With reference to FIG. 1 wherein there is shown an exploded view of a typical color picture tube, the tube 10 is depicted as having a face panel 12 including a rearwardly extending skirt 14. Skirt 14 is indicated as having a seal land 16 for attachment to a funnel 18 having a mating seal land 20.

Face panel 12 and its skirt 14 receive in the manufacturing process a uniform coating of electrically conductive dag 22. A dag coating (not shown) is also deposited on selected areas of the exterior of the tube envelope to form a capacitor in conjunction with the inner dag coating 22. The dag is essentially an aqueous dispersion of very fine graphite particles that form a coating microns thick on the glass of the tube. The water is driven off during a subsequent bake cycle to bake-harden the dag. The dag is also deposited on the inner surface of the funnel. It is necessary to remove the dag 22 from the areas of the seal lands 16 and 20 during the manufacturing process; otherwise, the juncture of the lands when frit sealed could be performed by a high-voltage discharge conducted from the outer dag through the sealed area to the inner dag 22.

Face panel 12 also receives on its inner surface a pattern of discrete phosphor deposits 24, indicated greatly enlarged in the inset. The phosphor deposits emit, when excited by one or more electron beams, red, green or blue light which comprise in combination the color image. The phosphor deposits are overlaid with an electrically conductive aluminum film 25, also indicated in the inset. The film serves three purposes; one is to reflect light emitted by the phosphor deposits under electron beam excitation toward the viewer to enhance image brightness. Another purpose is to intercept slow-moving ions which could otherwise bombard the screen and degrade phosphor emission. A third purpose is to provide a uniform electrical charge over the field of the phosphor deposits; this field plus the electrical charge on the dag coating provides for an equipotential field within the tube envelope. Parts receiving this same electrical potential comprise in combination the ultor anode; the potential applied is typically in the 25–30 kilovolt range. The potential is introduced into the envelope of tube 10 through an anode button 23 which perforates the glass of the funnel 18 to make electrical contact with the dag on the inner surface of funnel 18.

A shadow mask 26 is held dependent adjacent to face panel 12 by a plurality of metal studs 28 extending inwardly from skirt 14; three such studs 28 are indicated providing for three-point suspension of mask 26 with relation to face panel 12. Shadow mask 26 typically has a heavy frame 30 to which is welded a dished, apertured section 32 which is approximately six mils thick. The system for suspending mask 26 in proper relationship with face panel 12 includes a plurality of leaf springs 34. The spring 34, one of which is provided for engagement with each of the studs 28, are welded to the frame 30 of mask 26 at spaced points around the periphery thereof. The springs 34 have apertures at their distal ends which engage the studs 28. The shadow mask 26 is capable of being demounted from the face panel 12 and precisely remounted by depressing the springs 34 to disengage or re-engage the studs 28.

It is essential for proper cathode ray tube operation that the high voltage on the electrically conductive dag on the funnel 18 be also present on both the aluminum film and on the shadow mask 26. The electrical path for establishing these components at a common ultor anode potential commonly comprises a spring 36 which extends from the shadow mask 26 for contact with the high-voltage-charged dag coating on the inner surface of the funnel 18. The potential on the shadow mask is then conducted to the aluminum film through the shadow mask suspension springs 34 which are attached to the metal studs which extend inwardly from the skirt 14 of the face panel 12. The studs, which are embedded in the glass of the skirt 14, are intended to be in electrical contact with the aluminum film; however, this contact too often fails to be made. To ensure that the studs 28 are in positive electrical contact with the aluminum film, it has, as has been noted heretofore, been common practice to paint an electrically conductive bridge, or "mustache" between the studs 28 and the dag.

The process according to the invention provides for positive electrical connection between the shadow mask 28, the dag coating 22 and the aluminum film by way of studs 28.

For a thorough understanding of the inventive method, it is necessary to first review the present state-of-the-art method used in the processing of a cathode ray tube face panel. The processing comprises the following steps:

1. Wash panel 12 with caustic solution of sodium hydroxide.
2. Rinse panel 12 successively with city water, 12 percent solution of hydrofluoric acid, city water, and deionized water.
3. Rewet with deionized water if any drying has occurred.
4. Flood-coat inner surface of panel 12 with a solution of PVA (polyvinyl alcohol and dichromate) to render the surface photosensitive.
5. Dry PVA with air and radiant heat.
6. Multiple-expose the inner surface of panel 12 to actinic light through the apertures in the shadow mask 26. Three exposures are required, using a "lighthouse," to deposit discrete patterns for receiving red-, green- and blue-light emitting phosphor deposits.
7. Develop patterns by spraying with water.
8. Coat inner surface of panel 12 and skirt 14 with dag.
9. Spin panel 12 to level dag 22 and dry dag with radiant heat.
10. Maintain the dag 22 wet with water in the area between the plane of the studs 28 and the edge of the phosphor pattern field on the inner surface of the face panel 12.
11. Trim dag 22 from skirt 14 of panel 12 (including studs 28) to seal land 16, using hydrofluoric acid, and dry thoroughly.
12. Develop patterns on inner surface of the face panel 12 with a hydrogen peroxide wash. Development removes PVA patterns from beneath the dag 22, in effect reversing the image for receiving the respective red, green and blue phosphor deposits.

13. Develop with water spray to remove hydrogen peroxide, and erode the PVA and dag 22 from desired areas, and dry.

14. Successively deposit and develop the red, green and blue phosphors. Following each deposit, trim the phosphors with a water wash to remove phosphor from the studs 22 and area of the seal land 16.

15. Spray on lacquer film and dry with radiant heat.

16. Extend an electrically conductive mustache from the studs 28.

17. Aluminize inner surface of face panel 12, covering field of phosphor deposits.

Figure 2:
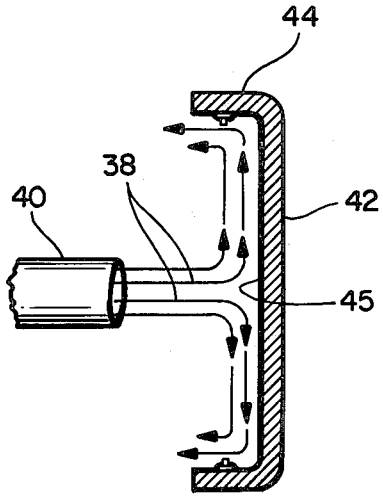
FIG. 2 is an elevational view of a face panel in cross section showing a flow of air according to the invention across the inner surface of the panel.

The improvement according to the invention comprises replacement of step 16—extending an electrically conductive mustache from the studs—with the following steps, with reference to FIG. 2;

A flow of air 38, depicted by the arrows, is directed from an air spout 40 towards the center of the inner surface of a face panel 42. The flow towards the center of the panel is effective to cause a counter-flow of air across the inner surface of skirt 44, as indicated by the arrows. The effect is to thoroughly dry the dag 45 on the skirt. The benefit in thorough drying is the prevention of the hydrofluoric acid used in a subsequent dag trimming operation from "wicking up" the coating of dag 45. By this means, a well-defined and controllably positioned "cut-off" line can be established between the bare glass (made bare by the hydrofluoric acid trim) and the dag 45. The air is of ambient temperature and is filtered and conditioned. The volume of flow is preferably about 600 cubic feet per minute, as flowing from a spout about six inches in diameter. The distance between the spout 40 and the inner surface of the panel 42 is preferably about twelve inches.

Figure 3:
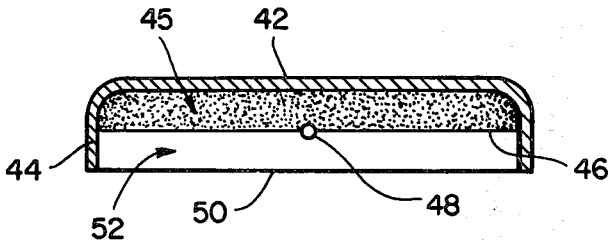
FIG. 3 is a view in elevation of a face panel showing schematically the effect of a dag trimming process according to the invention.

As indicated by FIG. 3, the area of the skirt 44 between the plane 46 of the stud(s) 48 and the skirt seal line 50 is then precision-trimmed with acid according to the invention to provide the well-defined cut-off line between the dag 45 and the bare glass area 52.

Figure 4:
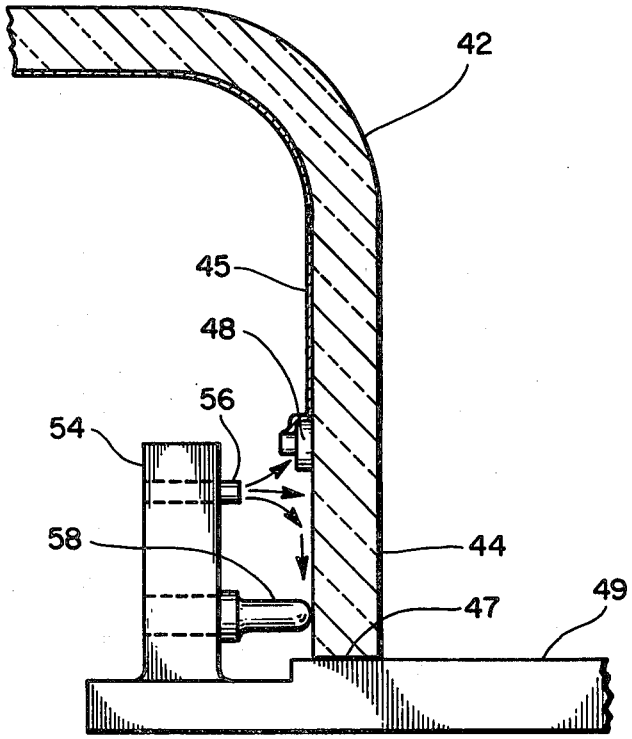
FIG. 4 is a view in elevation and in cross section showing an acid-trimming process directed to the skirt of the cathode ray tube according to the invention.

The preferred means for precision trimming according to the invention is depicted in FIG. 4. The skirt seal land 47 is shown as resting on a trim arm 49 as the face panel is rotated, with the seal land 47 riding on the trim arm 49. An acid trim head 54 dispenses hydrofluoric acid through an acid dispenser outlet 56 with a direction of flow as indicated by the arrows. A skirt guide 58 rides on the inner surface of skirt 44 to maintain even spacing between the acid trim head 54 and the skirt 44. The result is indicated by FIG. 3, wherein the well-defined cut-off line is generated at the plane 46 of the stud(s) 48. At the same time, the dag 45 will be noted as remaining in full electrical contact with the stud 48. The approximate rate of flow of the acid, which is preferably a four-percent solution of hydrofluoric, is about three milliliters a second.

The subsequent aluminizing of the face panel which covers the dag 45 and the stud(s) 48, as well as covering the phosphor deposits, re-enforces the electrical interconnection between dag 45, the stud(s) 48 and the shadow mask 26.

It must be recognized that changes may be made in the above-described process without departing from the true spirit and scope of the invention herein involved. It is intended that the subject matter in the above description shall be interpreted as illustrative and not in a limiting sense.

We claim:

1. For use in the manufacture of a cathode ray tube having a face panel including a rearwardly extending skirt with a seal land for attachment to a funnel having a mating seal land, said face panel and skirt receiving an internal coat of electrically conductive dag, said face panel having an inner surface for receiving a pattern of discrete phosphor deposits overlaid with electrically conductive aluminum film, said tube including a shadow mask for color selection receiving a high voltage and held dependent adjacent to said face panel by a plurality of metal studs extending inwardly from said skirt, an improved method for providing positive electrical connection between said shadow mask, said dag and said aluminum film by way of said studs, the method being of the type including the steps of:

(a) cleaning and drying the panel;

(b) depositing on said inner surface of said panel at least one photosensitive pattern for receiving said phosphor deposits;

(c) depositing an electrically conductive dag on said patterns and said skirt and drying said dag;

(d) rewetting said dag and trimming the dag from said skirt;

(e) developing said photo-sensitive material and depositing said phosphor on said pattern;

(f) removing excess phosphor from said skirt with a water wash;

(g) extending an electrically conductive bridge from said studs to said dag;

(h) aluminizing said inner surface of said panel; an improvement which comprises replacement of step (f) with the following steps:

directing a flow of air toward the center of the inner surface of said panel effective to cause a counterflow of air across the inner surface of said skirt to thoroughly dry the dag coating on said skirt;

precision-trimming with acid the area of said skirt between the plane of said studs and said skirt seal line, leaving intact the connection between the studs and the dag;

such that a permanent electrical connection is maintained between said dag coating and said shadow mask without the need for the application of an electrically conductive mustache.

* * * * *